US006007436A

United States Patent [19]

Mark

[11] Patent Number: 6,007,436

[45] Date of Patent: Dec. 28, 1999

[54] METHOD FOR EMPLOYING LIGHT FROM A LASER GENERATOR BEAM TO ASSIST IN AIMING A GOLF BALL AND APPARATUS THEREFOR

[76] Inventor: Phillip Mark, 1255 LaQuinta Dr., Suite 214, Orlando, Fla. 32809

[21] Appl. No.: 09/200,916

[22] Filed: Nov. 30, 1998

[51] Int. Cl.[6] ..... A63B 69/36

[52] U.S. Cl. ..... 473/409; 473/220; 473/257; 473/270; 473/280

[58] Field of Search ..... 473/220, 409, 473/270, 280, 257

[56] References Cited

U.S. PATENT DOCUMENTS

| | | | |
|---|---|---|---|
| 4,858,934 | 8/1989 | Ladick et al. | 473/220 |
| 5,193,812 | 3/1993 | Hendricksen . | |
| 5,207,429 | 5/1993 | Walmsley et al. | 473/220 |
| 5,217,228 | 6/1993 | Aguilar . | |
| 5,284,345 | 2/1994 | Jehn . | |
| 5,435,562 | 7/1995 | Stock et al. . | |
| 5,438,518 | 8/1995 | Bianco et al. . | |
| 5,452,897 | 9/1995 | Mick . | |
| 5,464,221 | 11/1995 | Carney . | |
| 5,464,222 | 11/1995 | Carney . | |
| 5,465,972 | 11/1995 | Cornett . | |
| 5,611,739 | 3/1997 | Carney . | |
| 5,655,973 | 8/1997 | McPherson, Jr. . | |
| 5,788,588 | 8/1998 | Hooker | 473/220 X |
| 5,818,036 | 10/1998 | Daly . | |

*Primary Examiner*—George J. Marlo
*Attorney, Agent, or Firm*—Eric P. Schellin

[57] ABSTRACT

The present invention is to a projected laser beam in a method for aligning a golf ball prior to hitting it with a golf club and a method for determining the proper feet position of a golfer prior to that golfer's hitting the golf ball. The laser beam is used to project a linearly extending light path across the ball. The laser has suitable optical means to also project a second light beam parallel to the first linearly extending light path and horizontally displaced therefrom. Additionally, the laser assembly includes a third light path that intersects the first and second light paths. The golfer may position his/her feet on either side of the intersecting light path. The laser is manually manipulated so that the first path of light is aligned in the direction of the pin at the end of the fairway.

3 Claims, 1 Drawing Sheet

METHOD FOR EMPLOYING LIGHT FROM A LASER GENERATOR BEAM TO ASSIST IN AIMING A GOLF BALL AND APPARATUS THEREFOR

BACKGROUND OF THE INVENTION

The present invention relates to a method and indicator, and relates more particularly to a laser indicator which is to be employed in golf training and in assisting in aiming the ball in the direction of the pin.

In playing the game of golf, a golf player must take a proper position so that the ball can be hit into each of a series of nine or eighteen holes in sequence, employing the fewest possible strokes. However, it is not easy for a novice to select the proper stance for the player's feet to ensure the best possible hit if the ball in the pre-selected direction towards the pin.

SUMMARY OF THE INVENTION

The present invention has been accomplished under the aforesaid circumstances. The present method includes aligning a to-be driven golf ball on the ground with a golf club. The method also includes positioning the filet of a golfer whereby the golf ball when hit is driven in a pre-selected direction in the direction of a cup on the green of a golf course.

The method includes positioning a conventional tee on the conventional tee off area. A ball is then mounted on the tee in the usual way.

A laser generator is held out at a predetermined height by a golfer in a manner whereby it projects light downwardly in the direction of the golf ball and thereonto. The light emitting laser is adapted and constructed to project a first extended linear light path across said golf ball and onto the ground on either side of the ball. The light emitting laser is also adapted and constructed to project a second extended linear light path onto the ground horizontally displaced and parallel to said first extended linear light path. Further, the light emitting laser is also adapted and constructed to project a third extended light path onto the golf ball and onto the ground. This third light path is perpendicular to both of the first and second light paths and intersect said first and second light paths.

To properly align the hitting surface of the golf club with the golf ball, the laser is rotated to the left or right until the first light path is aligned in the direction of a cup into which the golf ball is to be desirably hit. When this has been accomplished the second light path becomes a line against which the golfer places his or her feet. This is usually done so that one foot is on one side of the third light path and the other foot is positioned at the other side of the third light path.

DETAILED DESCRIPTION OF THE INVENTION

Figure 1:
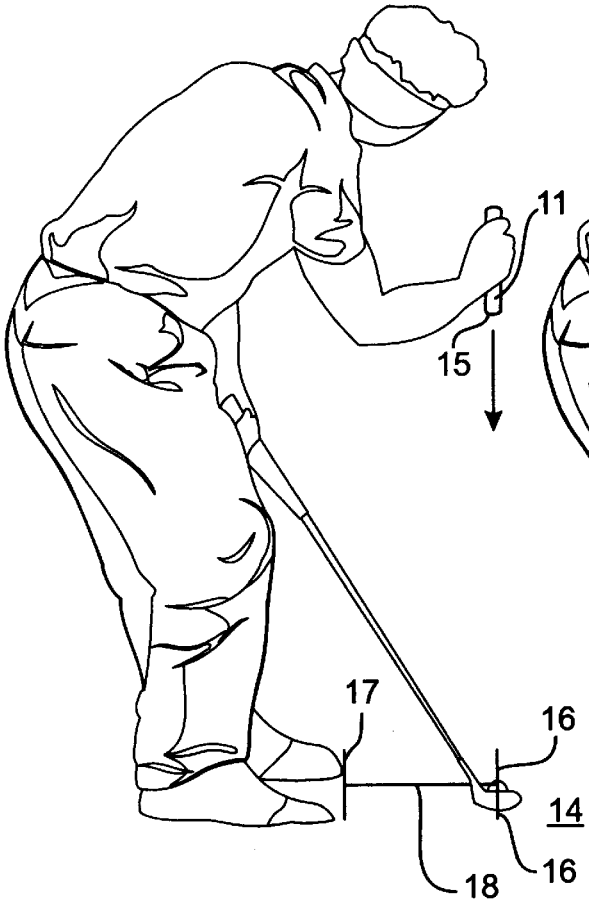
FIG. 1 depicts a golfer employing the laser in aligning the golf ball with the pin in the cup (not shown).
Figure 3:
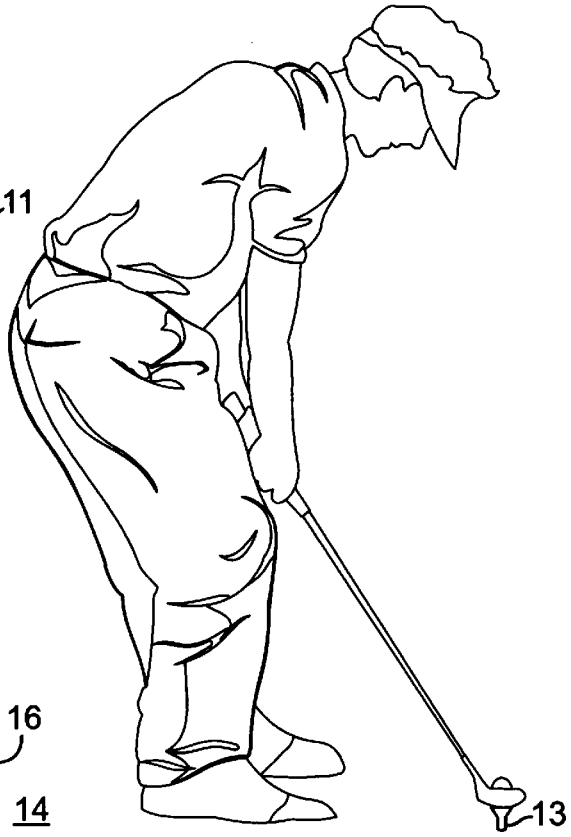
FIG. 3 depicts a golfer with a golf club addressing the golf ball prior to hitting the golf ball.
Figure 2:
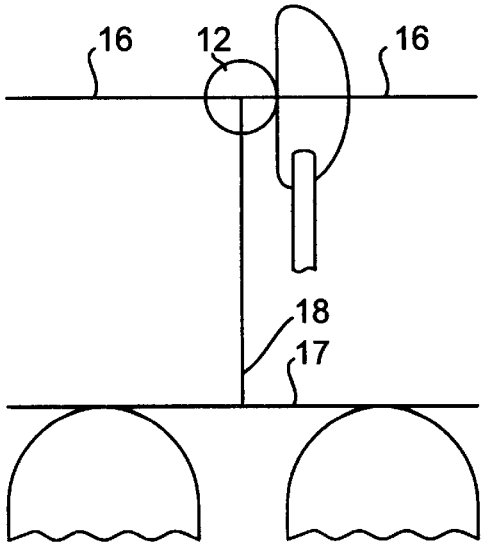
FIG. 2 depicts a golfer employing the laser in positioning his or her feet.

Attention is now directed to the drawings where reference numeral 11 refers, generally to a golfer. In FIG. 1 the golfer is depicted as holding out in front of his or her a pencil type laser generator 11 which projects a light beam vertically downwardly onto the top of a golf ball 12 which has been previously mounted on a golf tee 13 which has been pushed into the ground 14 in a conventional way. The light generator 11 has a grid/lens 15 at the surface of the light projecting area. The grid/lens 15 projects a first linear extending light path 16 onto the top surface of the ball and onto the ground 14 at either side of the ball for a relatively short distance.

The golfer rotates the laser and the grid/lens 15 thereof so that a golfer sights down this first light path in the direction of the pin at the end of the fairway. This feat can be done with ease so that the ball has been trued.

While being held as aforementioned the grid/lens 15 also projects a second linear light path 17 onto the ground which is horizontally displaced from the first light path and is parallel thereto.

Additionally the grid/lens 15 also projects a third linear light path 18 onto the golf ball and ground. The light path 18 intersects the first light path on the surface of the ball and the second light path 17 and is perpendicular to both light paths 16 and 17.

The second light path 17 is used as the line against which the feet of the golfer are placed for correctly addressing the golf ball. One foot of the golfer is positioned at one side of the light of the third path and the other foot is placed on the other side of the third light path.

When the golfer is satisfied that proper alignment and positioning has been obtained, the laser generator 11 is turned to the off position and may be then placed in the pocket of the golfer. The golf club is then taken up. As the feet of the golfer are in a proper position the golfer may strike the ball in the usual manner.

The laser generator is a conventional projection pen-light type device readily available in commerce. It is provided with a suitable lens arrangement whereby aforementioned light paths may be projected or displayed on the ground and across the ball which may be mounted on a tee or not as desired.

While such a pen-light configured laser generator usually projects a red light, it has been found that a red light does not project well on the grass of a golf course when there is bright sun light. Such difficulty can be partially ameliorated by a golfer by wearing glasses having a red filter. More to the liking of the golfer when there is bright sunshine is the use of a laser which projects a green light. Although, such a laser generator is more expensive.

In the foregoing the light paths 16, 17 and 18 depicted in the Figures shows solid linear lines. It is contemplated that the various light paths may be depicted dashes of light or even dots of light. As a matter of fact the paths of light may be in any combination of dots, dashes or linear paths.

Having described the invention in connection with the certain embodiments, further modifications will now suggest themselves to those skilled in he art. Therefore, the invention is not to be limited to the inventions as described, except as required by the appended claims.

I claim:

1. A method for aligning a golf ball on the ground with a golf club and aiding the positioning the feet of a golfer whereby the golf ball when hit is driven in a predetermined direction, comprising:

providing a golf ball providing and positioning a golf ball tee on the ground positioning said golf ball on said tee;

providing and physically directly hand holding a vertically downwardly projecting laser light source at a height above said golf ball on said tee;

said laser light source adapted and constructed to project a grid including a first extended linear light path across said golf ball and onto the ground on either side of the ball; a second extended linear light path onto the ground horizontally displaced and parallel to said first extended light path; a third extended light path onto the golf ball and onto the ground, said third light path being perpendicular to both of said first and second light paths and intersecting said first and second light paths;

rotating said laser whereby said first light path is aligned in the direction of a cup into which the golf ball is to be desirably hit;

positioning the feet of the golfer proximate the said second light path while maintaining a foot on either side of the said third light path.

2. The method of claim 1 wherein the laser light grid is in a red color.

3. The method of claim 2 wherein the golfer perceives the said light grid through a red filter.

* * * * *